US011624333B2

(12) United States Patent
Radue et al.

(10) Patent No.: US 11,624,333 B2
(45) Date of Patent: Apr. 11, 2023

(54) EXHAUST SAFETY SYSTEM FOR AN ENGINE

(71) Applicant: Kohler Co., Kohler, WI (US)

(72) Inventors: Martin Louis Radue, Plymouth, WI (US); Marshall Hau, Glenbeulah, WI (US); David Hasler, Kohler, WI (US); Donald Castle, Sheboygan, WI (US); Michael E. Smies, Waldo, WI (US)

(73) Assignee: KOHLER CO.

( * ) Notice: Subject to any disclaimer, the term of this patent is extended or adjusted under 35 U.S.C. 154(b) by 0 days.

(21) Appl. No.: 17/720,350

(22) Filed: Apr. 14, 2022

(65) Prior Publication Data

US 2022/0333545 A1 Oct. 20, 2022

Related U.S. Application Data

(60) Provisional application No. 63/177,000, filed on Apr. 20, 2021.

(51) Int. Cl.

| | |
|---|---|
| ***F02D 41/14*** | (2006.01) |
| ***F02P 11/02*** | (2006.01) |
| ***F02D 41/38*** | (2006.01) |

(52) U.S. Cl.

CPC ..... *F02D 41/1454* (2013.01); *F02D 41/1446* (2013.01); *F02D 41/38* (2013.01); *F02P 11/02* (2013.01); *F02D 2200/0802* (2013.01); *F02D 2400/06* (2013.01)

(58) Field of Classification Search

CPC ..... F02D 41/1446; F02D 41/1454; F02D 2200/0802; F02D 2200/0804; F02D 2400/06

USPC ..... 701/107, 109, 112; 123/198 DB, 123/198 DC, 479, 481, 673, 676, 690, 123/691

See application file for complete search history.

(56) References Cited

U.S. PATENT DOCUMENTS

| | | | | |
|---|---|---|---|---|
| 3,886,739 | A | 6/1975 | Lee | |
| 3,916,622 | A * | 11/1975 | Gospodar | F01N 3/18 123/198 F |
| 3,955,363 | A * | 5/1976 | Manderscheid | F02D 41/1443 60/285 |
| 4,379,387 | A * | 4/1983 | Iizuka | F02D 17/02 60/285 |
| 4,408,584 | A | 10/1983 | Yabuhara et al. | |

(Continued)

FOREIGN PATENT DOCUMENTS

| | | | |
|---|---|---|---|
| CN | 101709662 | A | 5/2010 |
| CN | 204024779 | U | 12/2014 |

(Continued)

*Primary Examiner* — Erick R Solis

(74) *Attorney, Agent, or Firm* — The Belles Group, P.C.

(57) ABSTRACT

Engine systems which are safer and have reduced risk of fire are desirable in a wide range of equipment markets. The present engine systems utilize sensors and control systems which reduce the probability of fire or spark exiting the exhaust system. The sensors may monitor a wide range of conditions within the exhaust system to alter the operating parameters of the engine to prevent ignition of objects adjacent the engine system during use. By altering operation of the engine, conditions such as exhaust temperature or unburned fuel can be controlled to minimize risk of undesired ignition.

20 Claims, 10 Drawing Sheets

(56) References Cited

U.S. PATENT DOCUMENTS 4,484,548 A * 11/1984 Sugasawa ..... F02D 41/0055 123/481
4,690,121 A 9/1987 Kawanabe et al.
4,729,220 A * 3/1988 Terasaka ..... F02D 41/0235 60/276
4,926,826 A 5/1990 Nakaniwa et al.
5,050,551 A 9/1991 Morikawa
5,107,432 A * 4/1992 Martinelli ..... F01N 3/20 701/123
5,168,701 A 12/1992 Yamamoto et al.
5,168,859 A * 12/1992 Ohsaki ..... G01M 15/104 123/681
5,201,293 A 4/1993 Langner et al.
5,414,994 A 5/1995 Cullen et al.
5,560,200 A 10/1996 Maus
5,647,207 A 7/1997 Grotjahn et al.
5,784,880 A 7/1998 Toshiro et al.
5,921,217 A 7/1999 Koike
6,032,753 A 3/2000 Yamazaki et al.
6,057,605 A 5/2000 Bourne et al.
6,068,528 A 5/2000 Suzuki
6,182,446 B1 2/2001 Gunther
6,240,910 B1 * 6/2001 Maekawa ..... F02D 41/0235 123/690
6,286,993 B1 9/2001 Boll
6,295,807 B1 10/2001 Douta et al.
6,532,926 B1 3/2003 Kuroda et al.
6,631,611 B2 10/2003 Shi et al.
6,711,891 B2 3/2004 Kitamura et al.
6,711,892 B2 3/2004 Tamura et al.
6,712,053 B2 3/2004 Kobayashi et al.
6,729,120 B2 5/2004 Freisinger et al.
6,739,122 B2 5/2004 Kitajima et al.
6,816,774 B2 11/2004 Yasui
6,829,886 B2 12/2004 Nakata
6,836,722 B2 12/2004 Yook
6,865,879 B2 3/2005 Andreas et al.
6,895,744 B2 5/2005 Osawa
6,901,745 B2 6/2005 Schnaibel et al.
6,920,388 B2 7/2005 Yasui
6,922,986 B2 8/2005 Rozario
6,935,312 B2 8/2005 Murase et al.
6,970,800 B2 11/2005 Park
6,996,974 B2 2/2006 Anilovich et al.
7,000,385 B2 2/2006 Miyashita
7,055,312 B2 6/2006 Osawa
7,059,115 B2 6/2006 Yasui
7,100,362 B2 9/2006 McGee et al.
7,143,574 B2 12/2006 Lewis et al.
7,150,145 B2 12/2006 Patchett et al.
7,152,395 B2 12/2006 Inoue et al.
7,162,359 B2 1/2007 Yasui
7,243,532 B2 * 7/2007 Tsujimura ..... G01M 15/11 73/114.02
7,249,453 B2 7/2007 Saito et al.
7,340,885 B2 3/2008 Colignon
7,398,645 B2 7/2008 Zheng et al.
7,430,853 B2 10/2008 Kohara et al.
7,474,956 B2 1/2009 Nakagawa et al.
7,549,285 B2 6/2009 Colignon
7,596,941 B2 10/2009 Takubo
7,603,850 B2 10/2009 Colignon
7,607,288 B2 10/2009 Miyasako et al.
7,634,907 B2 12/2009 Colignon
7,654,252 B2 2/2010 Kato et al.
7,677,027 B2 3/2010 Iida et al.
7,694,508 B2 4/2010 Iida et al.
7,778,764 B2 8/2010 Ito et al.
7,779,619 B2 8/2010 Takubo
7,809,490 B2 10/2010 Liu et al.
7,832,194 B2 11/2010 Ichimoto
7,845,160 B2 12/2010 Takubo
7,849,674 B2 12/2010 Masuda et al.
7,856,307 B2 12/2010 Atsushi et al.
7,895,826 B2 3/2011 Takubo
7,934,370 B2 5/2011 Ando et al.
8,024,105 B2 * 9/2011 Iwazaki ..... F01N 11/00 123/690
8,024,108 B2 * 9/2011 Hacker ..... F01N 3/2006 73/114.71
8,065,049 B2 11/2011 Sakamoto et al.
8,069,652 B2 12/2011 Iihoshi et al.
8,316,638 B2 * 11/2012 Tornambe ..... F01N 3/0238 123/331
8,381,707 B2 2/2013 Mizoguchi et al.
8,479,706 B2 7/2013 Speers et al.
8,544,258 B2 10/2013 Brown et al.
8,621,847 B2 1/2014 Gonze et al.
8,640,447 B2 2/2014 Nishi et al.
8,661,797 B2 3/2014 Gonze et al.
8,694,227 B2 4/2014 Tani et al.
8,707,679 B2 * 4/2014 McDonald ..... F02D 13/0284 60/285
8,707,680 B2 4/2014 Bisaiji
8,707,682 B2 4/2014 Bisaiji
8,713,923 B2 5/2014 Morita et al.
8,751,187 B2 6/2014 Hirai et al.
8,764,607 B2 7/2014 Gonze et al.
8,818,690 B2 8/2014 Tani et al.
8,894,540 B2 11/2014 Hashemi et al.
8,905,007 B2 12/2014 Iizuka et al.
8,918,267 B2 12/2014 Nakagawa
9,051,853 B2 6/2015 Gonze et al.
9,057,309 B2 6/2015 Yezerets et al.
9,140,173 B2 9/2015 Nakamura et al.
9,145,123 B2 9/2015 Doering et al.
9,145,804 B2 9/2015 Nakagawa
9,181,838 B2 11/2015 Drews
9,217,350 B2 12/2015 Upadhyay et al.
9,228,469 B2 1/2016 Devarakonda
9,249,712 B2 2/2016 Tani et al.
9,267,458 B2 2/2016 Sakaguchi et al.
9,273,583 B2 3/2016 Bergeal et al.
9,388,757 B2 7/2016 Onoe et al.
9,394,823 B2 7/2016 Choi
9,441,566 B2 9/2016 Takano et al.
9,458,812 B2 10/2016 Santoso et al.
9,567,938 B2 2/2017 Mori
9,593,635 B2 3/2017 Nakagawa
9,594,049 B2 3/2017 Yamada et al.
9,638,125 B2 5/2017 Tanaka et al.
9,650,981 B1 5/2017 Large et al.
9,664,640 B2 5/2017 Yamada et al.
9,752,523 B2 9/2017 Yoshikawa et al.
9,777,654 B2 10/2017 Qi et al.
9,816,961 B2 11/2017 Yamada et al.
9,845,719 B2 12/2017 Matsuoka et al.
9,903,262 B2 2/2018 Edwards et al.
9,925,974 B2 3/2018 Leone
9,932,916 B2 4/2018 Kondo et al.
9,995,233 B2 6/2018 Sasaki et al.
10,001,073 B2 6/2018 Gwidt et al.
10,006,394 B2 6/2018 Hayashita et al.
10,161,334 B2 12/2018 Ulrey
10,180,109 B2 1/2019 Okubo et al.
10,233,854 B1 3/2019 Attard et al.
10,234,418 B2 3/2019 Nakata et al.
10,265,657 B2 4/2019 Rhodes et al.
10,302,588 B2 5/2019 Matsuoka et al.
10,344,643 B2 7/2019 Otsuka et al.
10,443,519 B2 10/2019 Hashizume et al.
10,450,930 B2 10/2019 Smith et al.
10,473,049 B2 11/2019 Hayashita et al.
10,513,958 B2 12/2019 Aed
10,578,059 B2 3/2020 Badawy et al.
10,584,662 B2 3/2020 Cho
10,626,775 B2 4/2020 Umezawa et al.
10,634,027 B2 4/2020 Tanaka et al.
10,711,715 B2 7/2020 Glugla
10,718,250 B2 7/2020 Martin et al.
10,774,767 B2 9/2020 Ito
10,794,311 B2 10/2020 Wehmeier et al.
10,927,784 B2 2/2021 Hayashita et al.

(56) References Cited

U.S. PATENT DOCUMENTS

| | | | | |
|---|---|---|---|---|
| 2002/0069011 | A1* | 6/2002 | Hawkins | F02D 41/22 123/568.21 |
| 2002/0069638 | A1 | 6/2002 | Glugla et al. | |
| 2005/0216176 | A1 | 9/2005 | Ichimoto et al. | |
| 2005/0262827 | A1 | 12/2005 | Ichimoto et al. | |
| 2007/0095050 | A1 | 5/2007 | Asano | |
| 2010/0263639 | A1 | 10/2010 | Uhrich et al. | |
| 2013/0151125 | A1 | 6/2013 | Mann | |
| 2013/0275024 | A1 | 10/2013 | Shinji et al. | |
| 2015/0128565 | A1 | 5/2015 | Upadhyay et al. | |
| 2016/0265414 | A1 | 9/2016 | Devarakonda | |
| 2018/0135484 | A1 | 5/2018 | Hillen et al. | |
| 2019/0040782 | A1 | 2/2019 | Zenner | |
| 2020/0158030 | A1 | 5/2020 | Hitomi et al. | |
| 2020/0191071 | A1 | 6/2020 | Hitomi et al. | |
| 2020/0200109 | A1 | 6/2020 | Phillips | |
| 2021/0087995 | A1 | 3/2021 | Procknow | |

FOREIGN PATENT DOCUMENTS

| | | | |
|---|---|---|---|
| CN | 103133094 | B | 4/2015 |
| CN | 106640398 | A | 5/2017 |
| CN | 106939866 | A | 7/2017 |
| CN | 104395589 | B | 10/2017 |
| CN | 108001442 | A | 5/2018 |
| CN | 109236481 | A | 1/2019 |
| CN | 106194540 | B | 3/2019 |
| CN | 107642390 | B | 4/2019 |
| CN | 110295978 | A | 10/2019 |
| CN | 110691898 | A | 1/2020 |
| CN | 110863888 | A | 3/2020 |
| CN | 111005790 | A | 4/2020 |
| CN | 111456836 | A | 7/2020 |
| DE | 4430979 | A1 | 3/1995 |
| EP | 1173665 | A1 | 1/2002 |
| EP | 1174611 | B1 | 1/2002 |
| EP | 0890724 | B1 | 9/2003 |
| EP | 1352163 | B1 | 10/2003 |
| EP | 1680585 | B1 | 11/2008 |
| EP | 2360361 | B1 | 8/2011 |
| EP | 2119884 | B1 | 6/2012 |
| EP | 2075448 | B1 | 10/2016 |
| EP | 2987975 | B1 | 9/2017 |
| EP | 2865860 | | 10/2017 |
| EP | 3333389 | A1 | 6/2018 |
| EP | 3404226 | B1 | 1/2020 |
| EP | 3269954 | | 10/2020 |
| JP | S61265336 | A | 11/1986 |
| JP | H0617640 | A | 1/1994 |
| JP | H0674025 | A | 3/1994 |
| JP | H07269407 | A | 10/1995 |
| JP | H0849585 | A | 2/1996 |
| JP | H08232722 | A | 9/1996 |
| JP | H0942024 | A | 2/1997 |
| JP | H09126014 | A | 5/1997 |
| JP | H09317526 | A | 12/1997 |
| JP | H09317531 | A | 12/1997 |
| JP | H11182296 | A | 7/1999 |
| JP | 2005036742 | A | 2/2005 |
| JP | 2012218710 | | 11/2012 |
| JP | 2012241574 | A | 12/2012 |
| JP | 2014141945 | A | 8/2014 |
| JP | 2014213643 | A | 11/2014 |
| JP | 2017089461 | A | 5/2017 |
| JP | 2019015259 | A | 1/2019 |
| JP | 2020139440 | A | 9/2020 |
| KR | 101048120 | B1 | 7/2011 |
| WO | WO2006005862 | A1 | 1/2006 |
| WO | WO2014163046 | | 10/2014 |
| WO | WO2015181922 | | 12/2015 |
| WO | WO2019239025 | A1 | 12/2019 |
| WO | WO2020035921 | | 2/2020 |
| WO | WO2020166154 | | 8/2020 |
| WO | WO2020217642 | | 10/2020 |

* cited by examiner

EXHAUST SAFETY SYSTEM FOR AN ENGINE

CROSS-REFERENCE TO RELATED APPLICATIONS

The present application claims the benefit of priority to U.S. Provisional Application No. 63/177,000 filed Apr. 20, 2021, which is incorporated herein by reference in its entirety.

BACKGROUND

The present invention generally relates to control systems for internal combustion engines, and more particularly to systems and devices or apparatuses for such engines. Internal combustion engines utilize a variety of emissions and exhaust control devices. Engine exhaust from internal combustion engines is generally very hot, and can be a source of ignition. Various methods are utilized to control engine exhaust for safety and other reasons. The present disclosure provides solutions for engine exhaust control.

Improvements are desired to ensure that hot engine exhaust does not present a fire hazard to operators, surrounding property, or the environment. This beneficially ensures that these internal combustion engines can be operated in dry or other potentially hazardous conditions. Equipment safety is improved, resulting in greater utility of engine powered equipment in all environmental conditions and locations.

SUMMARY

The present application discloses systems to improve control of exhaust of an internal combustion engine. The engine system selectively controls engine operation in response to characteristics of the engine or its exhaust.

In some implementations, the engine system has an internal engine, a control unit, and a first sensor. The engine has an intake having a fuel/air mixer, a first combustion chamber fluidly coupled to the intake, a first ignition source operably coupled to the first combustion chamber, and an exhaust system fluidly coupled to the first combustion chamber and extending from the first combustion chamber to an outlet. The control unit is configured to control at least one of the fuel/air mixer or the first ignition source. The first sensor is configured to sense a first condition of exhaust within the exhaust system. In response to a first signal from the first sensor, the control unit transitions from 1) a first state where the fuel/air mixer delivers fuel to the first combustion chamber and the fuel is ignited via the first ignition source to 2) a second state where the control unit either controls the fuel/air mixer to cease delivery of fuel to the first combustion chamber or controls the first ignition source to prevent ignition of the fuel.

In other implementations, the engine system has an internal combustion engine, a control unit, and a first sensor. The engine has an intake having a fuel/air mixer, a first combustion chamber fluidly coupled to the intake, a first ignition source operably coupled to the first combustion chamber, and an exhaust system fluidly coupled to the first combustion chamber and extending from the first combustion chamber to an outlet. The control unit is configured to control at least one of the fuel/air mixer or the first ignition source. The first sensor is configured to sense a first condition of exhaust within the exhaust system, the first sensor outputting a first signal which is received by the control unit. In response to the first signal exceeding a first predetermined threshold while the engine is in a running state, the control unit either causes the fuel/air mixer to cease delivery of fuel or the first ignition source to prevent ignition of the fuel.

In yet other implementations, a method of controlling an internal combustion engine is disclosed. In step a), an engine is provided, the engine having an intake comprising a fuel/air mixer, a first combustion chamber fluidly coupled to the intake, a first ignition source operably coupled to the first combustion chamber, and an exhaust system fluidly coupled to the first combustion chamber and extending from the first combustion chamber to an outlet, the engine in a running state. In step b), a sensor operably coupled to the exhaust system senses a first condition of exhaust within the exhaust system exceeding a first predetermined threshold. In step c), fuel delivery from the fuel/air mixer is interrupted or ignition of the fuel by the first ignition source is prevented. In step d), the sensor monitors the first condition of the exhaust until the first condition of the exhaust is less than a second predetermined threshold. During step e), fuel delivery from the fuel/air mixer and ignition of the fuel by the first ignition source are resumed.

Further areas of applicability of the present invention will become apparent from the detailed description provided hereinafter. It should be understood that the detailed description and specific examples, while indicating the preferred implementation of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
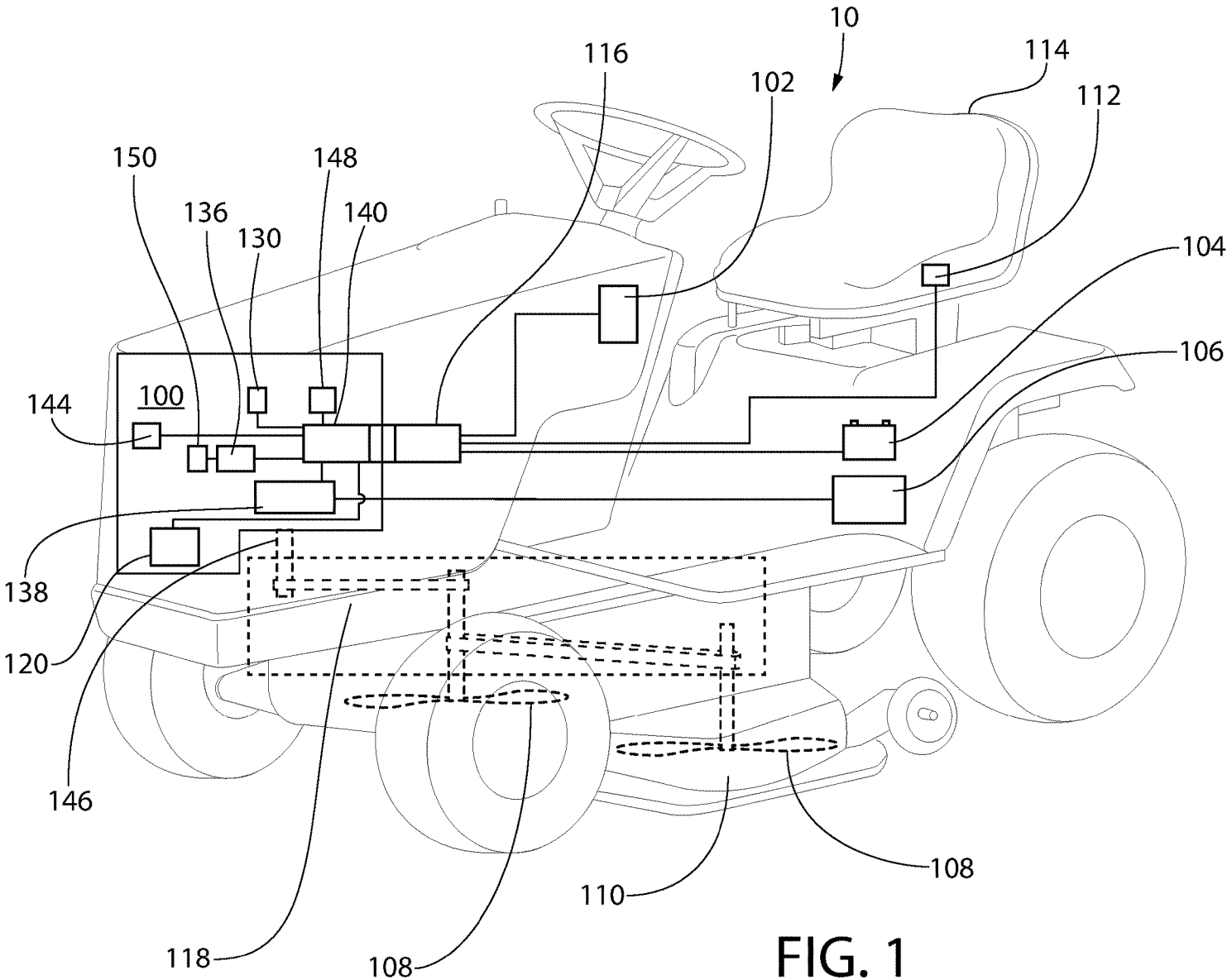
FIG. 1 is a schematic view of a lawn mower utilizing an internal combustion engine according to the present invention.

All drawings are schematic and not necessarily to scale. Features shown numbered in certain figures which may appear un-numbered in other figures are the same features unless noted otherwise herein.

DETAILED DESCRIPTION

The features and benefits of the invention are illustrated and described herein by reference to non-limiting examples in which aspects of the disclosure may be embodied. This description of examples is intended to be read in connection with the accompanying drawings or photos, which are to be considered part of the entire written description. Accordingly, the disclosure expressly should not be limited to such examples illustrating some possible non-limiting combination of features that may exist alone or in other combinations of features disclosed herein.

In the description of examples disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIG. 1 shows a perspective view of a riding type lawn mower 10 having an engine 100 which may utilize a control system according to the present disclosure. In one exemplary implementation, the lawn mower 10 includes an engine system 100, an ignition switch 102, an energy storage device 104, a fuel supply 106, two cutting blades 108 in a mower deck 110, a safety switch 112, a seat 114, a machine wiring harness 116, and a transmission 118. The engine system 100 includes an internal combustion engine 120, a stator 130, one or more ignition coils 136, one or more ignition sources 150, a control unit 138, an engine wiring harness 140, and a fuel air mixer 144. Optionally, the ignition source 150 may be a spark plug. In alternate implementations, the ignition coils 136 and ignition sources 150 may be replaced by a glow plug or other passive ignition source. In yet other implementations, the ignition coils 136 may be replaced by a magneto or other device to provide ignition to the engine 120.

The engine system 100 may also include a starter motor 148 to start the engine 120 without the need for manual starting. The engine 120 of the engine system 100 has an output shaft 146 which operatively connects to the transmission 118. The transmission 118 provides engine power to the cutting blades 108 and motive power for the lawn mower 10. In some implementations, the energy storage device 104 may be a battery. In other implementations, the energy storage device 104 may be a capacitor or other device for storing electrical energy. Under normal operating conditions, the energy storage device 104 provides all electrical energy required to start and run the engine 120 from a non-running state.

The lawn mower 10 of the exemplary implementation is typically operated by turning the ignition switch 102 to the "on" position, which provides electrical energy from the energy storage device 104 to the engine system 100 via the machine wiring harness 116. This electrical energy is then distributed to the various components of the engine system 100 as required. For instance, the control unit 138 and the coil 136 would typically be powered when the ignition switch 102 is in the on position. The safety switch 112 is typically deactivated by the operator sitting on the seat 114, allowing starting of the engine. At this time, the ignition switch 102 may be turned to the start position and the engine 120 started. The engine 120 typically continues to run as long as the fuel supply 106 continues to supply fuel to the engine 120, until the safety switch 112 is activated (ie. altered to a second state), or until the ignition switch 102 is turned to the "off" position. While the engine is running, the first stator 130 is supplying charging current to the energy storage device 104, recharging it for future running cycles of the engine 120.

Figure 2:
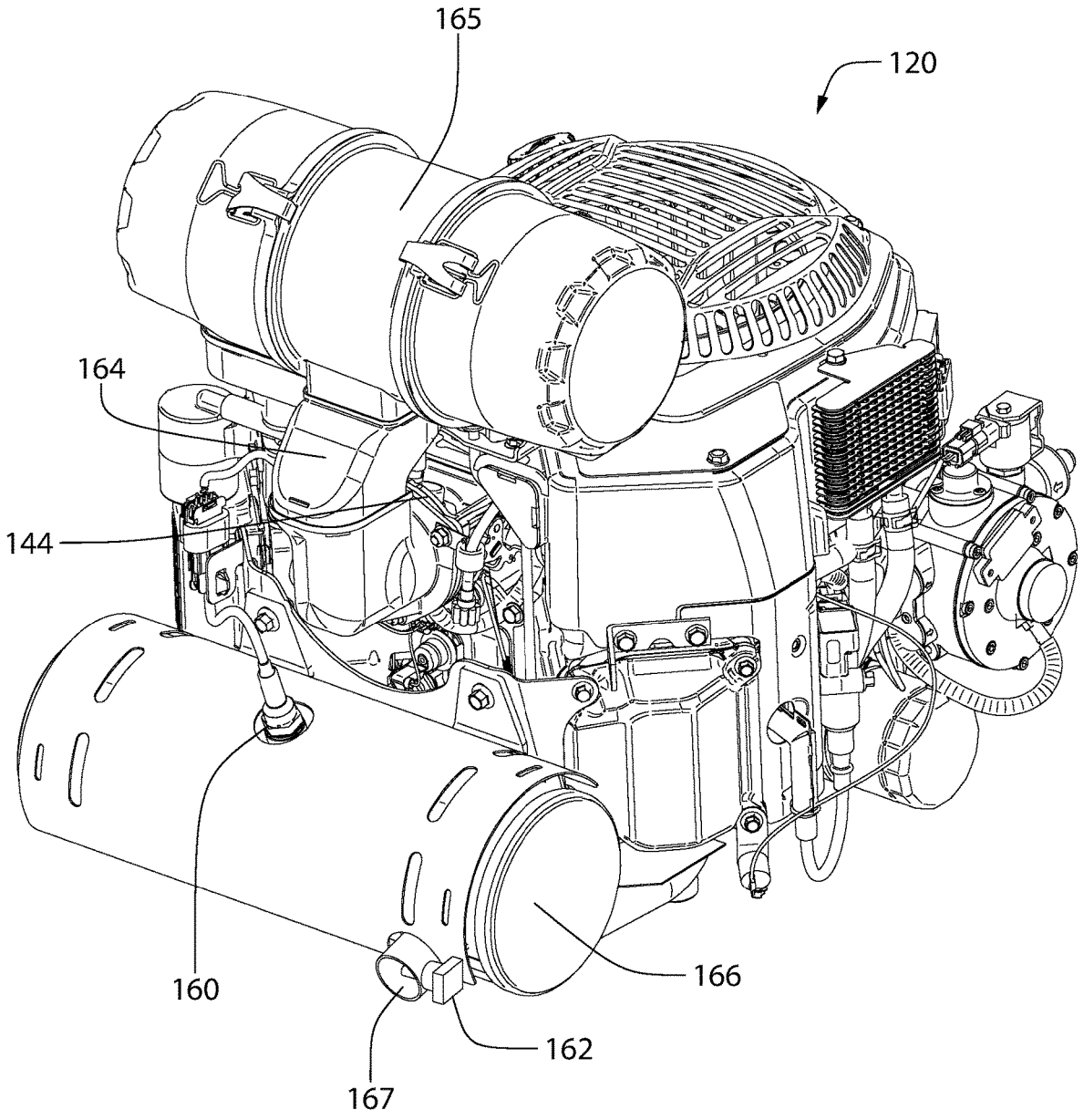
FIG. 2 is a perspective view of a representative internal combustion engine as may be utilized in the lawn mower of FIG. 1.

FIG. 2 shows a representative engine 120 as may be installed in the lawn mower 10 or other engine powered equipment. The engine 120 has an intake 164 optionally including an air filter 165. The engine 120 also has a fuel/air mixer 144 such as a carburetor or a combination of a fuel injector and a throttle body. The fuel/air mixer 144 forms a part of the intake 164 of the engine 120. Two spark plugs serve as ignition sources 150. The spark plugs, in combination with one or more ignition coils 136, generate the spark required to ignite an air/fuel mixture. The engine 120 has two cylinders. Each cylinder has a combustion chamber where the ignition of the air/fuel mixture occurs. The combustion chambers are internal to the engine 120 and in fluid communication with the intake 164. The ignition source 150 is operably coupled to the combustion chambers to ensure that the air/fuel mixture can be ignited effectively. In other implementations, the engine 120 may not have cylinders, instead having alternate internal engine configurations. Nonetheless, the engine 120 has one or more combustion chambers.

The engine 120 also has an exhaust system 166 which may incorporate a muffler or other sound reduction device. The exhaust system 166 is fluidly coupled to the combustion chamber of the engine 120 to facilitate removal of exhaust gases which are generated by ignition of the air/fuel mixture. The exhaust system 166 extends from the combustion chamber to an outlet 167, with exhaust exiting the exhaust system 166 at the outlet 167. The exhaust system 166 may have a pair of runners, a catalyst, and a muffler as discussed in greater detail below. An oxygen sensor 160 and a temperature sensor 162 are mounted to the exhaust system 166 to sense conditions of exhaust within the exhaust system 166. The oxygen sensor 160 and the temperature sensor 162 may measure conditions of the exhaust. These conditions may include oxygen content, air/fuel ratio, temperature, or any other characteristic within the exhaust at any location within the exhaust system 166. For instance, temperature may be measured at different points within the exhaust system 166, generating additional characteristic data. These various characteristics may be used to alter operation of the engine 120.

Optionally, one, two, or more than two combustion chambers may be utilized. Similarly, any number of ignition sources 150 may be utilized. It is conceived that each combustion chamber may have a single ignition source 150 or more than one ignition source 150. The intake 164 may have a plurality of distinct intake runners, which may be separate or may be interconnected. Similarly, the exhaust system 166 may have a plurality of distinct exhaust runners, which may be separate or interconnected. Thus, a plurality of outlets 167 and a plurality of mufflers may form the exhaust system 166.

Figure 3:
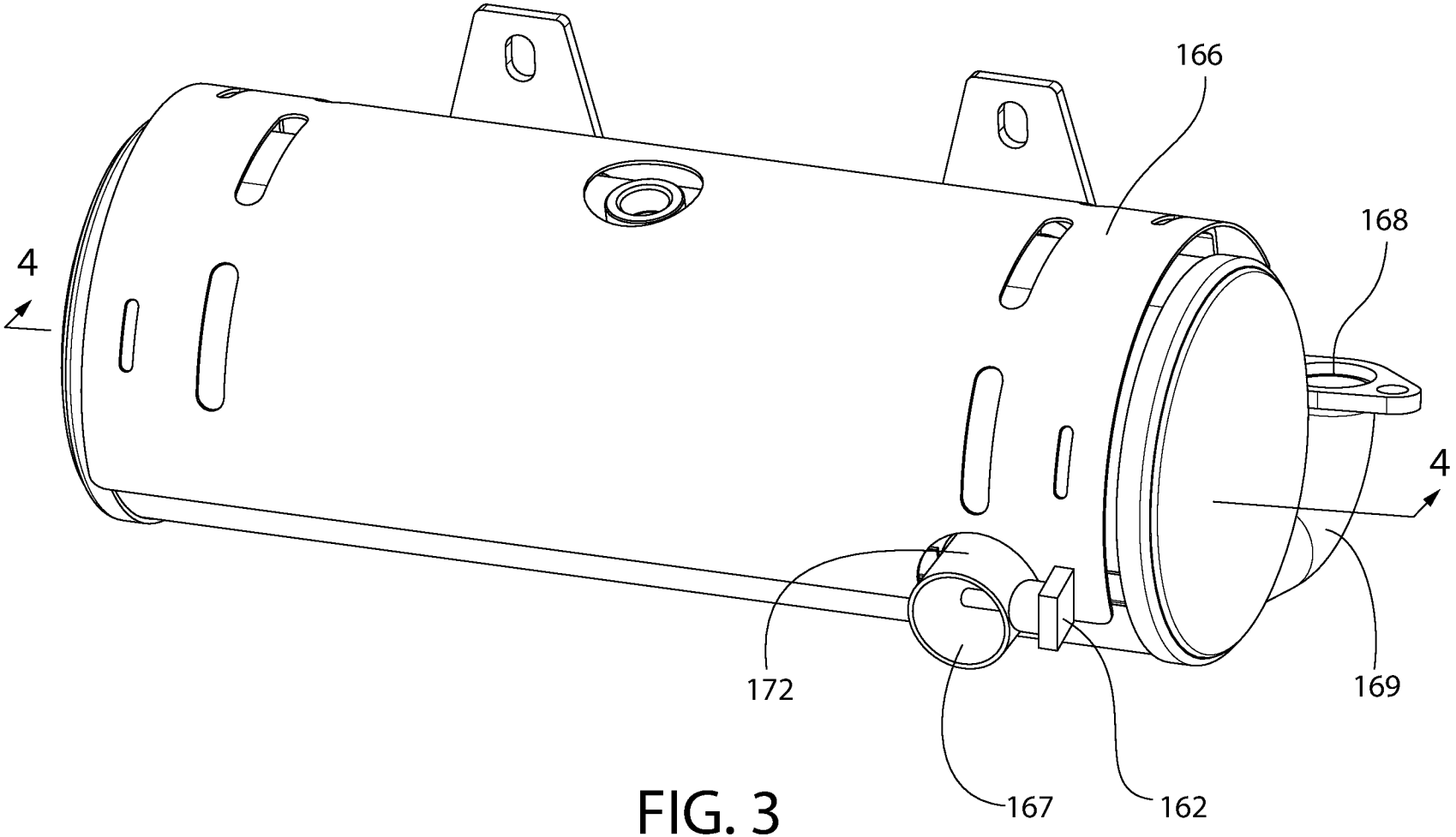
FIG. 3 is a perspective view showing an exhaust system as may be utilized with the engine of FIG. 2.
Figure 4:
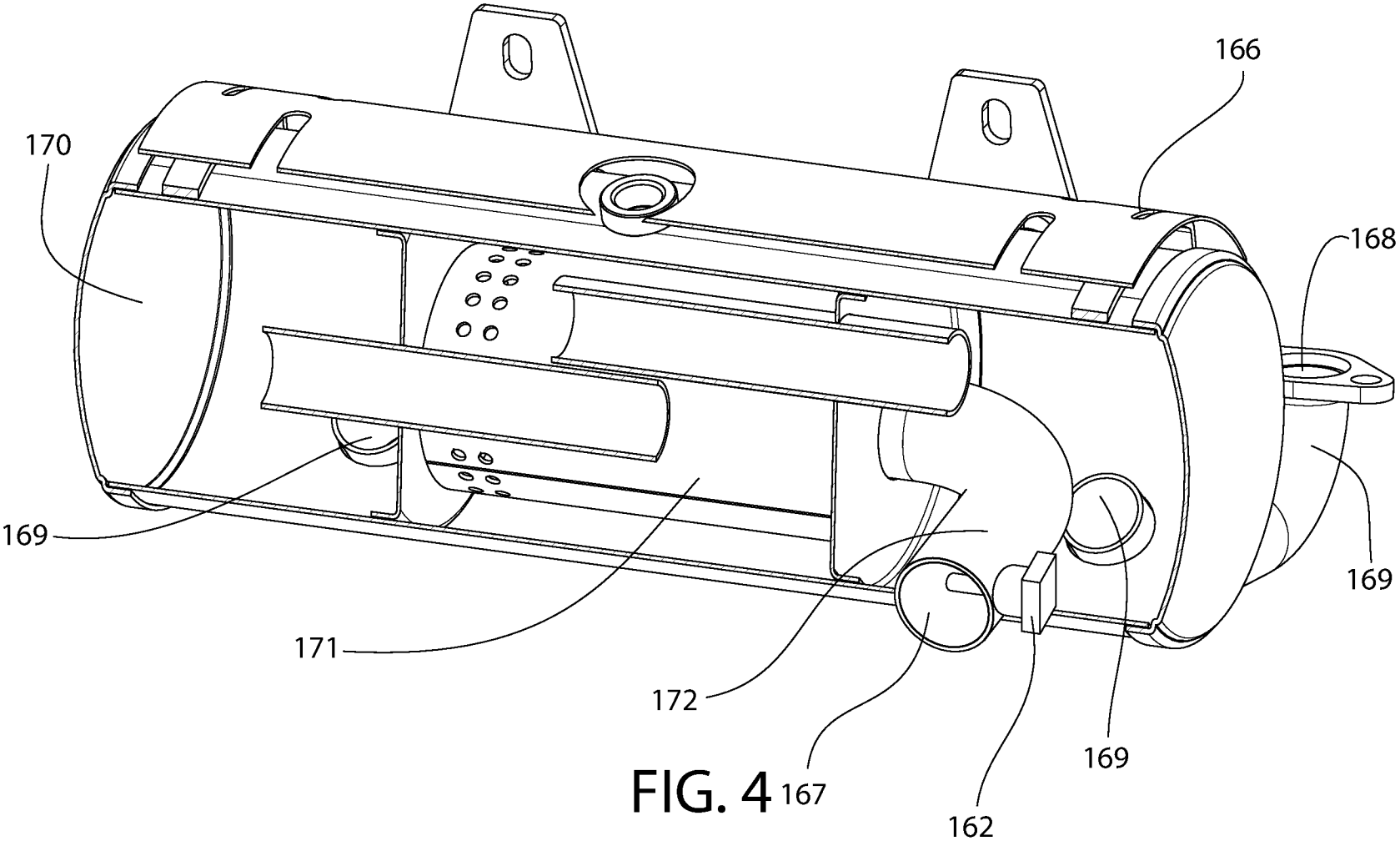
FIG. 4 is a cutaway view showing the internal construction of the exhaust system.

Turning to FIGS. 3 and 4, the exhaust system 166 is shown in greater detail. The exhaust system extends from one or more ports 168 to one or more outlets 167. The ports 168 typically interface with corresponding ports on an engine block or head to provide fluid connection between the combustion chamber and the exhaust system 166. In some implementations multiple combustion chambers may couple to a single port 168 of the exhaust system 166. In the present example, the exhaust system 166 has two ports 168. Runners 169 extend from the ports 168 to a central cavity 170.

A catalyst 171 is located within the central cavity 170. Baffles and tubes may be located within the central cavity 170 to facilitate sound reduction, while the catalyst 171 facilitates reactions within the exhaust gases to reduce pollution emitted from the engine 120. For instance, the catalyst 171 may promote reaction of unburned fuel, nitrous oxides, and similar reaction byproducts to nitrogen, carbon dioxide, and other exhaust components which are less harmful. Optionally, the catalyst 171 may be omitted. A tailpipe 172 extends from the central cavity 170 and terminates at the outlet 167, allowing exhaust to vent to the outside environment. The temperature sensor 162 is mounted in the tailpipe 172 proximate the outlet 167, the temperature sensor 162 measuring a temperature of the exhaust exiting the exhaust system 166.

The temperature sensor 162 outputs a signal which corresponds to the temperature of the exhaust exiting the exhaust system 166. In some implementations, this may be a voltage or current which has a known relationship to the measured temperature. In yet other implementations, the temperature sensor 162 may utilize a variable resistance with a known relationship to the measured temperature. Any known temperature sensing method may be used by the temperature sensor 162. Optionally, the temperature sensor 162 may be located such that it senses temperature in the runners 169 or a portion of the central cavity 170. The temperature sensor 162 may be located either upstream or downstream of the catalyst 171. In yet other variations, the catalyst 171 may be a separate component connected by exhaust tubing, and need not be internal to the central cavity 170 of the exhaust system. The catalyst 171 may be upstream or downstream of the central cavity 170 which serves as the muffler in the present example.

The signal from the temperature sensor 162 is delivered to the control unit 138. Optionally, the control unit 138 may be configured as a single control module performing all engine control functions. In other implementations, the control unit 138 may be configured as a plurality of individual modules which perform different functions. These individual modules may be linked via a communication link such as a bus or other interconnection method. Thus, the control unit 138 may be configured in a wide range of different ways to achieve control of the engine 120. In some implementations, the control unit 138 may also perform control of some or all functions of the equipment into which the engine 120 is integrated.

The oxygen sensor 160 may also be operably coupled to the exhaust system 166, the oxygen sensor 160 providing information regarding oxygen content in the exhaust. The oxygen sensor 160 may be utilized to determine an air/fuel ratio of the air/fuel mixture provided to the combustion chamber and make corrections to the amount of fuel or air which is delivered to the combustion chamber. This may be useful for a variety of purposes such as reducing emissions, increasing power, or improving fuel efficiency, among others. The oxygen sensor 160 is mounted to detect the air/fuel ratio of the exhaust within the central cavity 170 upstream of the catalyst 171. However, in other implementations two or more oxygen sensors 160 may be utilized. These oxygen sensors 160 may be installed upstream and downstream of the catalyst 171 to measure catalyst efficiency or may be mounted in the runners 169 to permit measurement of the air/fuel ratio in individual combustion chambers. In yet other implementations, the oxygen sensor 160 may be omitted.

The oxygen sensor 160 generates a signal that corresponds to the oxygen content of the exhaust. The oxygen content then has a known relationship to the air/fuel ratio of the mixture which is delivered to the combustion chamber, assuming that the mixture is properly combusted. The oxygen sensor 160 may be a "wide band" type sensor which is capable of measuring oxygen content over a wide range, as opposed to a "narrow band" type sensor which is generally limited to measuring oxygen content around the stoichiometric ratio for a given fuel. The signal generated by the oxygen sensor 160 is then delivered to the control unit 138 and used to alter engine operating parameters such as the quantity of fuel delivered.

In a first configuration, the system operates by monitoring the temperature of the exhaust in the tailpipe 172. More particularly, the temperature sensor 162 provides a signal to the control unit 138 which indicates the temperature of the exhaust in the tailpipe 172 adjacent the outlet 167. During certain operating conditions of the engine, it is possible that the exhaust may reach dangerously high temperatures. At some temperatures, depending on environmental conditions, quantity of unburned fuel, and a variety of other conditions, unburned fuel in the exhaust can ignite and cause a flame or spark to exit the exhaust system 166. Alternately, hot exhaust or sparks within the exhaust can ignite combustible materials which are near the outlet 167 of the exhaust system 166.

Excessive unburned fuel in the exhaust can be caused by an excessively rich fuel mixture, a cylinder which did not receive a spark, or other conditions. For instance, a leaking fuel injector or software fault could cause the fuel/air mixer 144 to deliver too much fuel. Alternatively, a weak ignition coil 136, failing spark plug or other ignition source 150, damaged or disconnected spark wire, or other ignition system faults could cause a weak or no-spark condition in a combustion chamber. This would allow unburned fuel to pass through the combustion chamber to the exhaust system 166. These are a selection of potential faults that could allow unburned fuel to reach the catalyst 171. Numerous other possibilities could result in increased fire risk.

When at operating temperature, the catalyst 171 causes unburned fuel to react. In the event of a large amount of unburned fuel, a flame can extend beyond the outlet 167 of the tailpipe 172. As is apparent, this could result in a fire if dry leaves or other flammable material is nearby. This condition is of particular concern in areas where natural materials might be inadvertently ignited to cause a highly destructive fire. Additionally, an operator or other individual could be injured by an exhaust spark or flame.

In the present example, the system monitors the temperature of the exhaust gas at the tailpipe using the temperature sensor 162. This monitoring is performed by the control unit 138. The signal corresponding to the measured temperature is then compared against a first predetermined threshold, the first predetermined threshold being selected to be less than the probable ignition temperature of the unburned fuel or the probable ignition temperature of environmental materials such as leaves. When the engine 120 is in a running condition and the measured temperature has not exceeded the first predetermined threshold, the system is in a first state. Thus, the first state is the state at which normal engine operation occurs and there is minimal risk of undesired ignition of environmental materials.

In response to the measured temperature exceeding the first predetermined threshold, the control unit 138 triggers fuel cutoff and the system enters a second state. The control unit 138 may cause a fuel cutoff valve to close, cease fuel injector operation, or otherwise halt fuel flow to the engine. In yet other implementations, only spark or both fuel and spark may be halted, ensuring an immediate shutdown of the engine. Otherwise stated, the fuel/air mixer 144 may cease delivery of fuel and/or the ignition source 150 may be controlled to cease ignition of the fuel/air mixture. Either or both approaches prevent continued fuel burn and reduce the chance of flame or spark exiting the exhaust system. Excess fuel resulting from a lack of ignition can be vented to atmosphere safely so long as the catalyst 171 or other parts of the exhaust system 166 do not exceed the ignition temperature of the fuel.

Optionally only a single combustion chamber's fuel flow or ignition source may be halted. In other configurations all fuel flow may be halted. The engine 120 may remain in a running state while the system is in the second state. The engine 120 may continue running by coasting or by power provided by another combustion chamber or bank of combustion chambers. The system may then return to the first state once the measured temperature drops below a second predetermined threshold. The second predetermined threshold may be greater than, less than, or equal to the first predetermined threshold. The system may remain in the second state for a predetermined period of time to ensure that measurement noise or other errors do not result in undesired switching between modes, resulting in erratic operation.

Figure 5:
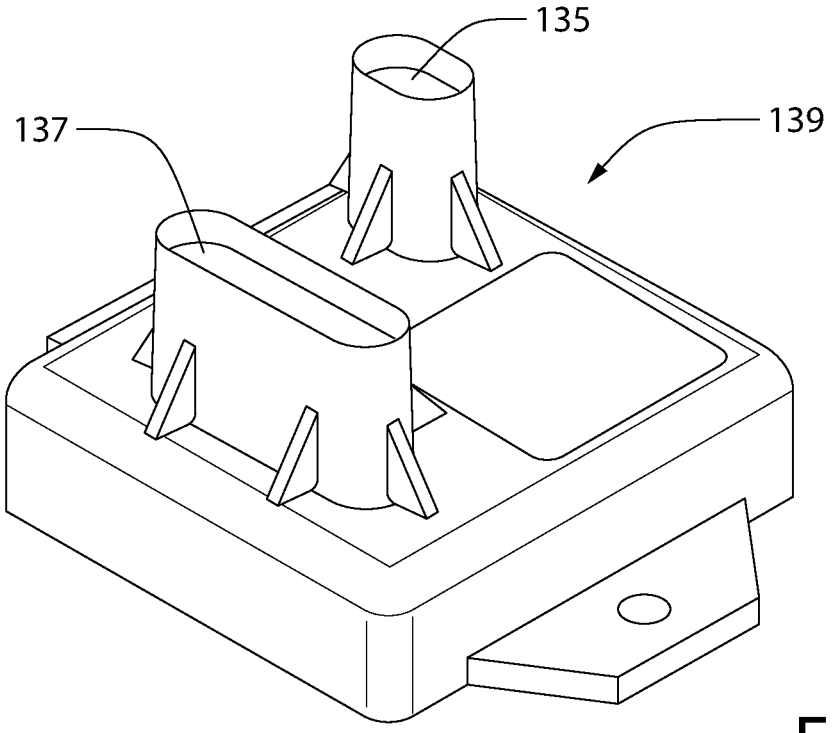
FIG. 5 is a perspective view of an exemplary control module as may be utilized in combination with the exhaust system.

FIG. 5 illustrates a control module 139 which forms a part of the control unit 138. The control module 139 connects to the temperature sensor 162 via a first connector 135 and interprets the signals from the temperature sensor 162. This information is then passed to other modules within the control unit 138 via a second connector 137 to permit switching from the first state to the second state. As discussed previously, the control module 139 may be integrated into a single control unit 138 rather than being a separate module 139 within the control unit 138. Alternately, the control module 139 may perform additional functions beyond interpreting signals from the temperature sensor 162.

Figure 6:
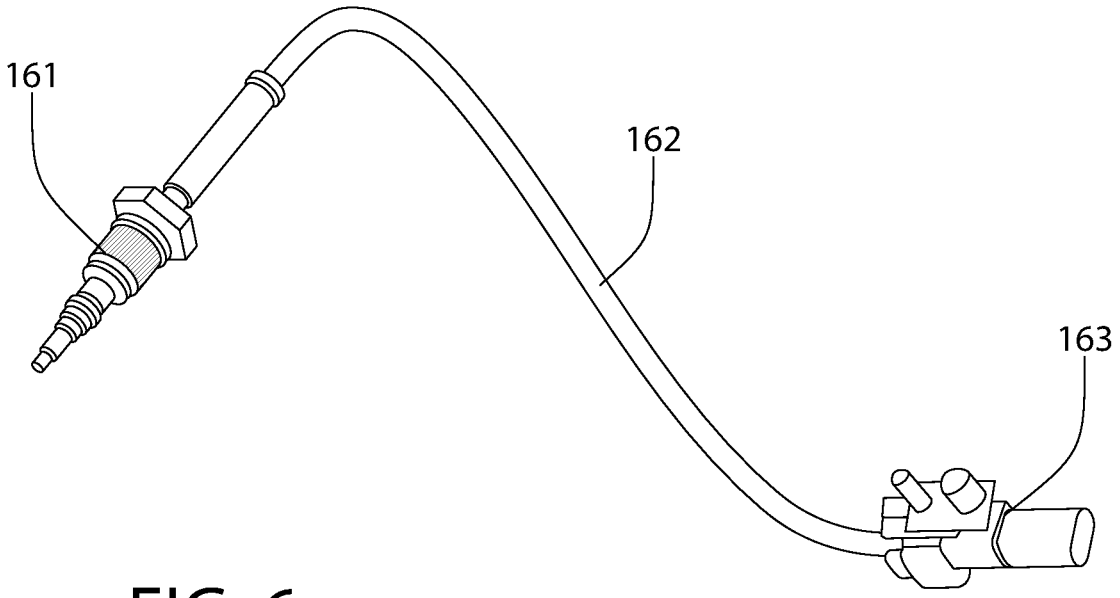
FIG. 6 is a perspective view of an exemplary sensor as may be utilized in combination with the exhaust system.

FIG. 6 illustrates an exemplary temperature sensor 162 such as may be used in the present system. The temperature sensor 162 has a probe 161 that may mount to the tailpipe 172 via a threaded connection, press fit, or any of a number of alternate mounting methods. The temperature sensor 162 may be a voltage, current, or resistance type sensor, or it may operate using a digital communications protocol to transmit the signal containing the temperature measurement information. The temperature sensor 162 may be a thermistor, thermocouple, or other temperature sensing device. Signals are transferred via a connector 163 to the first connector 135 of the control module 139. The connector 163 may be any type suitable for mating with the first connector 135 of the control module. Preferably, the probe 161 is mounted as near to a center of the tailpipe 172 adjacent the outlet 167 to provide fast response time and accurate measurement of the exhaust temperature. Alternately, the probe 161 may be mounted anywhere within the exhaust system 166 and need not be in the center of exhaust gas flow.

Figure 7:
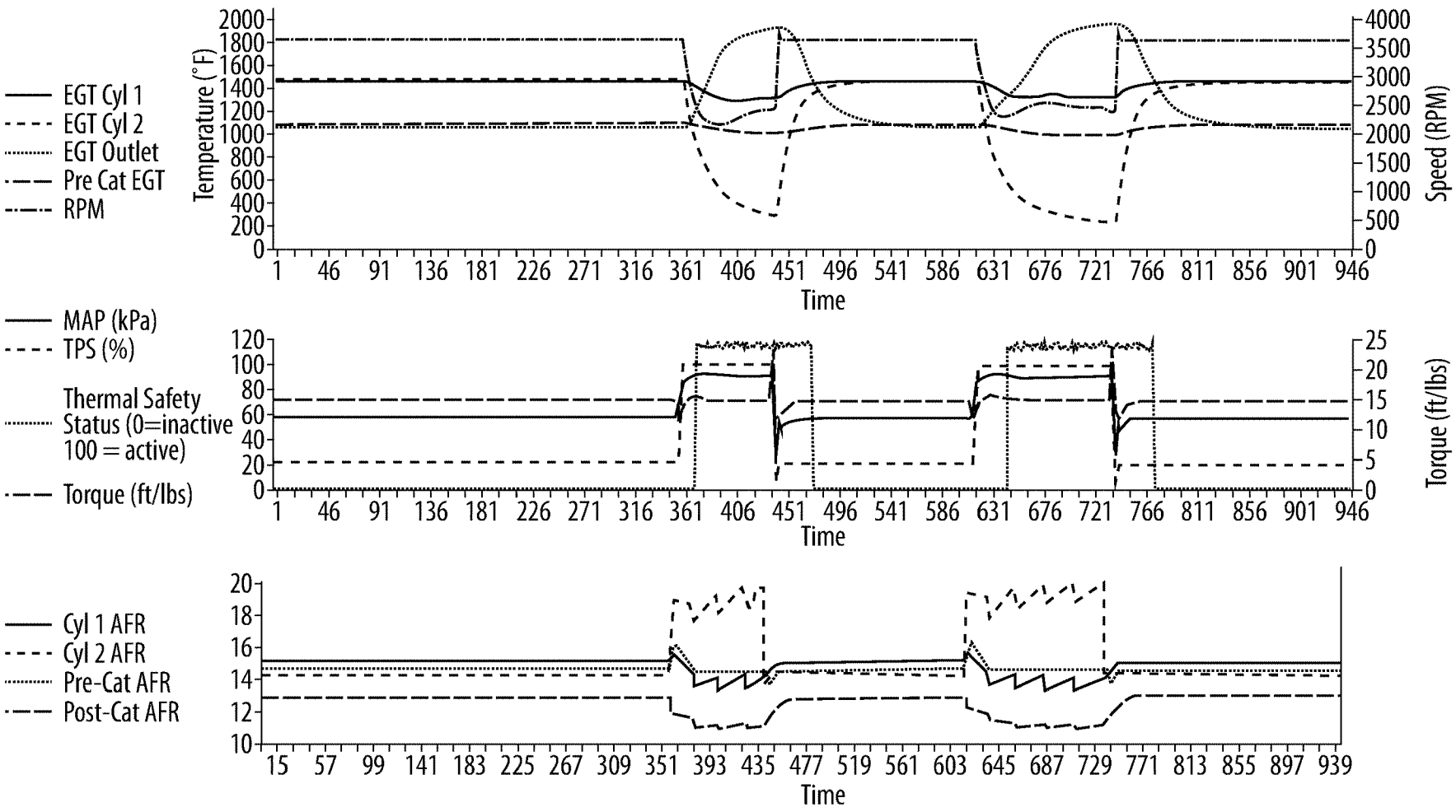
FIG. 7 is a plurality of graphs showing data measured during operation of the exhaust safety system in various states.

FIG. 7 shows three graphs of experimental data illustrating a variety of measured data. All of the data was recorded concurrently as evidenced by the time scale shown at the bottom of each of the graphs. The time scale is measured in seconds. Turning to the top graph, exhaust gas temperature ("EGT") of cylinders 1 and 2 of the engine 120 are plotted. EGT of cylinders 1 and 2 is measured as it exits the combustion chamber and before it reaches the muffler or catalyst. These temperatures are measured in the runners 169 of the exhaust system 166 where no significant mixing of the exhaust gas occurs. EGT Outlet is the temperature of the exhaust gas at the outlet 167 of the tailpipe 172 as measured by the temperature sensor 162. Pre Cat EGT is the temperature of the exhaust gas upstream of the catalyst 171 but downstream of the cylinder 1 and cylinder 2 measurements. This measurement is taken in the central cavity 170 where the exhaust gas from cylinder 1 and cylinder 2 has mixed. In other words, the Pre Cat EGT is measured immediately upstream of the catalyst 171. RPM, or revolutions per minute, indicates the engine speed.

Turning to the middle graph of FIG. 7, manifold air pressure ("MAP") in kPa, throttle position ("TPS") in percent of full opening, thermal safety status, and engine output torque are plotted. The bottom graph of FIG. 7 shows cylinder 1 air/fuel ratio ("AFR"), cylinder 2 AFR, pre-catalyst AFR, and post-catalyst AFR. The AFR's are measured at substantially the same positions as the exhaust gas temperatures noted above using oxygen sensors 160.

At approximately 360 seconds, ignition is shut off in cylinder 2. As can be seen, EGT for cylinder 2 rapidly drops as unburned fuel flows through the engine to the exhaust. However, EGT at the tailpipe rapidly climbs beyond 1800 degrees F. This causes a dangerous condition where fire is highly likely. As can be seen in the middle graph, the thermal safety status is triggered at approximately 376 seconds, which corresponds to a first predetermined threshold of 1500 degrees at the outlet 167 of the tailpipe 172. A thermal safety status of 100 corresponds to a value greater or equal to the first predetermined threshold at the outlet 167 while a thermal safety status of 0 corresponds to a value less than the second predetermined threshold for the outlet 167. In this instance, the first and second predetermined thresholds are the same. For the purposes of testing, fuel flow was not halted as evidenced by the RPM not dropping to zero when the thermal safety status reaches 100. However, the engine would quickly shut down as a result of halting the fuel flow, reducing the temperature at the outlet 167 rapidly and keeping it below the first predetermined threshold.

As can be seen from FIG. 7, ignition in cylinder 2 was restored at approximately 450 seconds. EGT outlet temperature rapidly dropped as the amount of unburned fuel reaching the catalyst decreased. At approximately 481 seconds, the thermal safety status went from 100 to 0, indicating a safe exhaust temperature. The test was repeated, with ignition shut off at approximately 620 seconds and resumed at approximately 740 seconds. Once again, EGT outlet temperature climbs until the first predetermined threshold of 1500 degrees F. is reached. At that time, the thermal safety status is 100 and the system transitions from the first state to the second state. Thermal safety status returns to 0 when the EGT outlet temperature has dropped below the second predetermined threshold of 1500 degrees F., subsequent to the ignition being restored. The system then transitions from the second state to the first state. As noted above, the first and second predetermined thresholds are the same in this test, but they may be different in other implementations. Thus, the removal of ignition from cylinder 2 was used to simulate a malfunction where excess fuel is passed through one of the combustion chambers. This verified proper operation of the system and illustrated issues that can result from excess unburned fuel.

As can be seen, the AFR of cylinder 2 indicates approximately 18-20 on the graph when the ignition in cylinder 2 is shut off. This is due to the excess of oxygen resulting from the fuel not being burned. The actual air/fuel ratio cannot be accurately determined in the absence of spark. However, it provides yet another indicator of a potential malfunction. The AFR of cylinder 1 also shows some erratic decreases in measured AFR from the steady values before and after interruption of ignition in cylinder 2. This may be caused by some slight mixing of exhaust between the two runners 169 or other factors.

Figure 8:
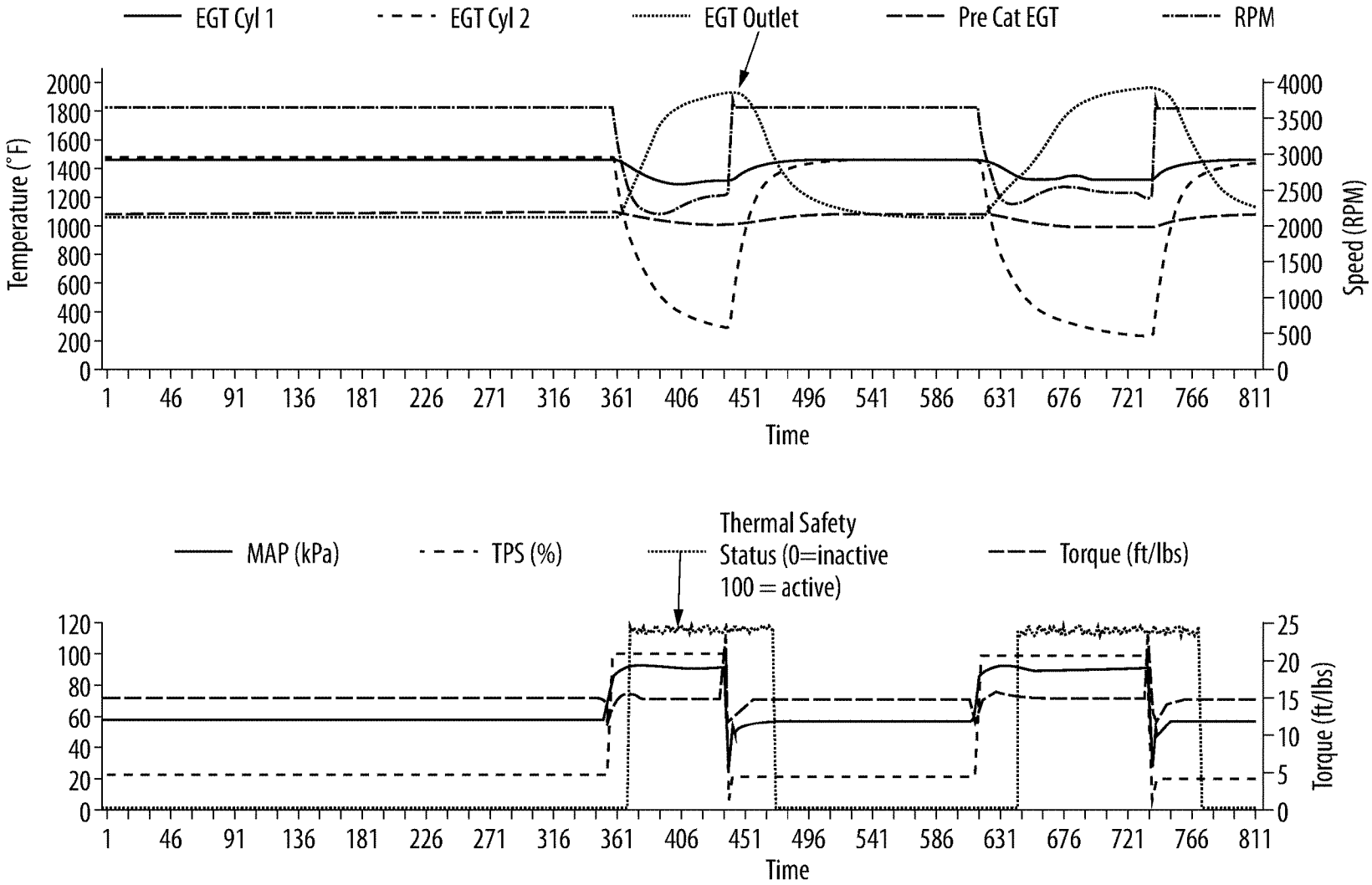
FIG. 8 is a plurality of graphs showing data measured during operation of the exhaust safety system in various states with additional annotations.

FIG. 8 shows the same graphs as the top and middle graphs of FIG. 6, but have been annotated with arrows showing that as the EGT outlet temperature reaches the first predetermined threshold of 1500 degree F., the thermal safety status is 100. This highlights the ability of the control module 139 to detect and respond to temperatures exceeding the first predetermined threshold. The first and second predetermined thresholds may be any desired value and may vary depending on environmental conditions, fuel type, engine type, and so on. The first and second predetermined thresholds may be changed in response to selected inputs such as ambient temperature. The system may utilize the control module 139 or another module within the control unit 138 such as the engine controller to monitor inputs and transition from the first state to the second state and vice versa. Furthermore, the first and second predetermined thresholds may be altered by another module within the control unit 138 via a communication bus such as CAN bus. The first and second predetermined thresholds may be altered based on sensor data transmitted over the CAN bus that is utilized to compute a new predetermined threshold or the predetermined threshold value may be transmitted directly, with no additional computation required to determine the predetermined threshold value. In the case of predetermined thresholds that may vary, these thresholds may be dictated by an algorithm that takes into account various risk factors to adjust the predetermined threshold values.

Where the engine has more than one combustion chamber, there may be third and fourth predetermined thresholds that correspond to the second combustion chamber and so on. In other words, each combustion chamber may have two predetermined thresholds which relate to the value at which the transition from a normal state to a safety state. Each combustion chamber may also have two states. Thus, a first combustion chamber may transition from a first state to a second state when a first condition of the exhaust rises to the first predetermined threshold. The first combustion chamber may transition from the second state to the first state when the first condition of the exhaust drops below the second predetermined threshold. A second combustion chamber may transition from a third state to a fourth state when a second condition of the exhaust rises to a third predetermined threshold. The second combustion chamber may transition from the fourth state to the third state when the second condition of the exhaust drops below a fourth predetermined threshold. Thus, each combustion chamber may have separate predetermined thresholds which are dictated by different conditions within the exhaust system. These conditions may be temperature, air fuel ratio, or any other parameter which may indicate potential danger.

Figure 9:
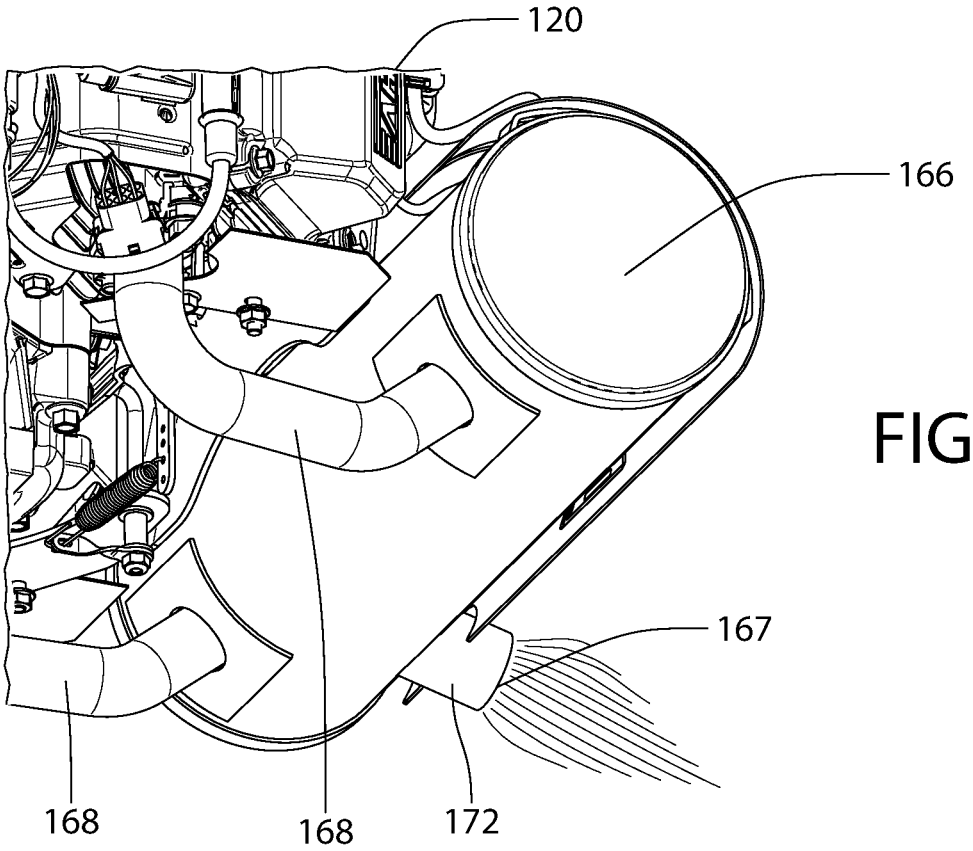
FIG. 9 is a bottom perspective view of an engine showing a flame exiting the exhaust system.
Figure 10:
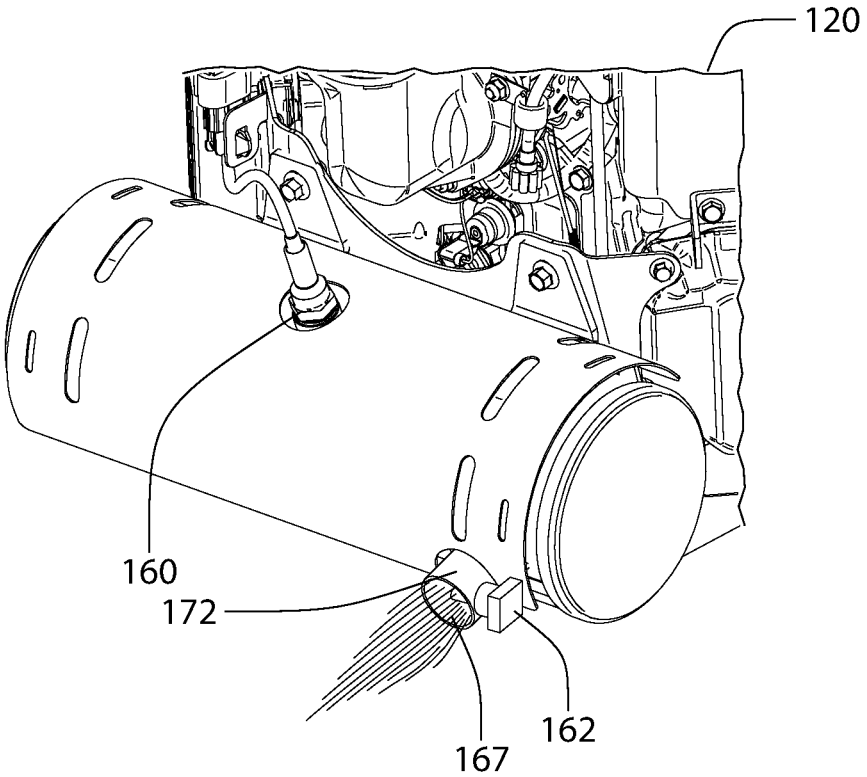
FIG. 10 is a top perspective view of the engine showing a flame exiting the exhaust system.

FIGS. 9 and 10 show a flame exiting the tailpipe 172 of the exhaust system 166 of the engine 120. These flames were generated during controlled tests and were intentionally generated for testing purposes. As can be seen, the flames extend a significant distance from the tailpipe and present a significant safety hazard.

Figure 11:
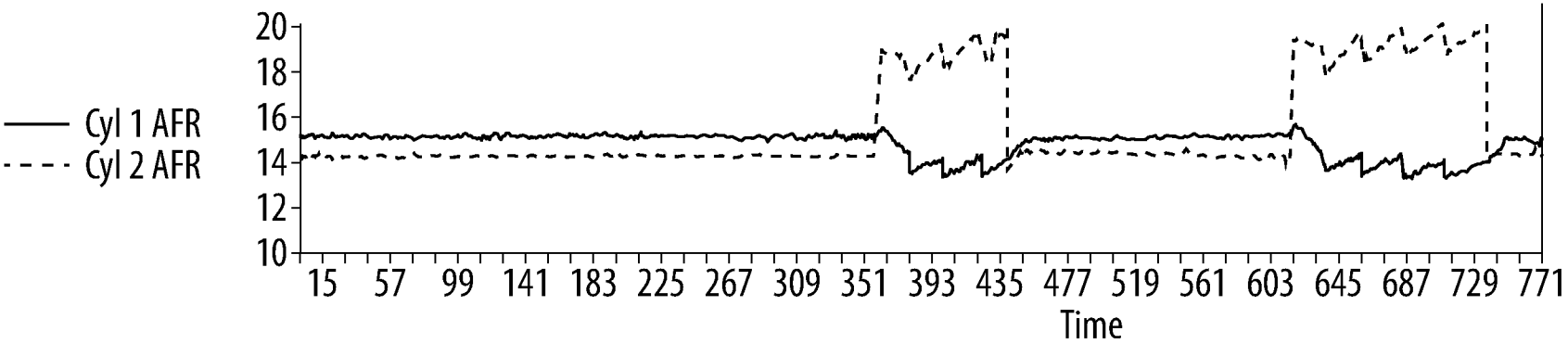
FIG. 11 is a graph showing air/fuel ratio data measured during operation of the exhaust safety system in various states.

Turning to an alternative configuration, FIG. 11 shows air/fuel ratio measurements from cylinders 1 and 2 during testing. As can be seen, the AFR of cylinder 2 deviates substantially from the steady state value. An alternative system may omit the temperature sensor 162 at the outlet 167 and may instead cut fuel based on the AFR readings from oxygen sensors 160 located in the runners 169. In the event of a large deviation from the expected value, the control unit 138 can trigger a transition from the first state to the second state or from the third state to the fourth state. This discontinues ignition and/or fuel delivery. This has the advantage of quicker response times but does not directly measure temperature of the exhaust at the outlet 167.

Optionally, the temperature sensor 162 may be maintained to provide two sources of feedback. Otherwise stated, two or more conditions of the exhaust within the exhaust system 166 may be concurrently monitored. This may allow a hybrid algorithm to be implemented which can result in a predetermined threshold that is adjusted based on weighting of signals from the various sensors 160, 162 to deliver enhanced safety and eliminate false positives. Thus, the predetermined thresholds may take the form of an algorithm which weights various signals from various sensors 160, 162.

Figure 12:
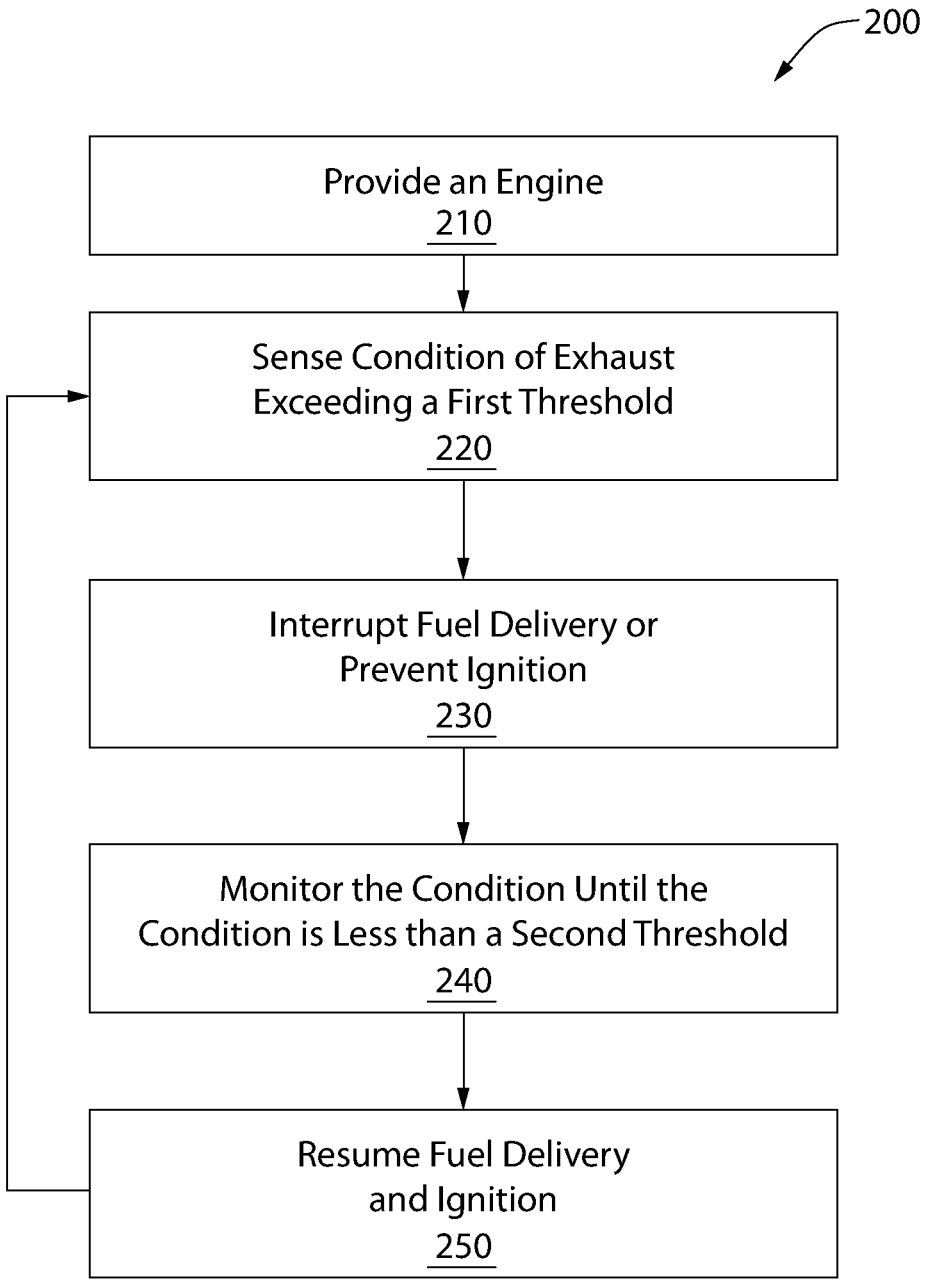
FIG. 12 is a flow chart illustrating a method of controlling an internal combustion engine.

FIG. 12 illustrates a method of controlling an internal combustion engine 200. Step 210 involves providing an engine 120. The engine 120 has an intake 164 having a fuel/air mixer 144, a first combustion chamber fluidly coupled to the intake 164, a first ignition source 150 operably coupled to the first combustion chamber, and an exhaust system 166 fluidly coupled to the first combustion chamber and extending from the first combustion chamber to an outlet 167. Optionally, the engine 120 may be in a running state.

Step 220 involves sensing via a sensor, such as the oxygen sensor 160 or temperature sensor 162, a first condition of exhaust within the exhaust system 166. The first condition may be a temperature, oxygen content, or air/fuel ratio at a specific location within the exhaust system 166. The sensor, in combination with a control unit 138, monitors the first condition until the first condition exceeds a predetermined threshold. The first predetermined threshold may be a single value or may be dictated by an algorithm that weighs various additional factors to compute the predetermined threshold.

During step 230, the control unit 138 interrupts fuel delivery from the fuel/air mixer 144 or prevents ignition of fuel by the first ignition source 150 in response to the first condition exceeding the first predetermined threshold. As a result of step 230, the system transitions from a first state to a second state. Subsequently, in step 240, the sensor monitors the first condition of the exhaust until the first condition drops below a second predetermined threshold. The second predetermined threshold may be greater, less than, or equal to the first predetermined threshold. Finally, in step 250 the fuel delivery is resumed from the fuel/air mixer 144 and/or the ignition of the fuel is resumed by the first ignition source 150. This allows the system to return to the first state from the second state. The cycle may continue so long as the engine is running of the control unit 138 is active, with the system returning to step 220 to continue monitoring the first condition of the exhaust. In the event that the first condition exceeds the first predetermined threshold, the process repeats as described.

While the foregoing description and drawings represent examples of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed examples are therefore to be considered in all respects as illustrative and not restrictive, the scope of the invention being defined by the appended claims and equivalents thereof, and not limited to the foregoing description or examples. Rather, the appended claims should be construed broadly, to include other variants of the invention, which may be made by those skilled in the art without departing from the scope and range of equivalents of the invention.

What is claimed is:

1. An engine system comprising:

an internal combustion engine comprising:

an intake comprising a fuel/air mixer;

a first combustion chamber fluidly coupled to the intake;

a first ignition source operably coupled to the first combustion chamber; and an exhaust system fluidly coupled to the first combustion chamber and extending from the first combustion chamber to an outlet, the exhaust system comprising a tailpipe adjacent the outlet;

a control unit configured to control at least one of the fuel/air mixer or the first ignition source; and a first sensor configured to sense a first condition of exhaust within the exhaust system, the first sensor configured to sense the exhaust at the tailpipe;

wherein, in response to a first signal from the first sensor, the control unit transitions from 1) a first state where the fuel/air mixer delivers fuel to the first combustion chamber and the fuel is ignited via the first ignition source to 2) a second state where the control unit either controls the fuel/air mixer to cease delivery of fuel to the first combustion chamber or controls the first ignition source to prevent ignition of the fuel.

2. The system according to claim 1 wherein the control unit transitions from the first state to the second state when the first signal exceeds a first predetermined threshold.

3. The system according to claim 2 wherein the control unit transitions from the second state to the first state when the first signal is less than a second predetermined threshold.

4. The system according to claim 1 wherein the first signal indicates a temperature of the exhaust within the exhaust system.

5. The system according to claim 1 wherein the first signal indicates a ratio of air to fuel.

6. The system according to claim 1 wherein the exhaust system comprises a catalyst located between the first combustion chamber and the tailpipe, the first sensor configured to sense the exhaust within the exhaust system between the catalyst and the outlet.

7. The system according to claim 1 wherein the system comprises a second sensor, the engine comprises a second combustion chamber, and the exhaust system comprises a first runner fluidly coupled to the first combustion chamber and a second runner fluidly coupled to the second combustion chamber, wherein the first sensor senses the first condition of the exhaust within the first runner and the second sensor senses a second condition of the exhaust within the second runner.

8. The system according to claim 7 wherein, in response to a second signal from the second sensor, the control unit transitions from 1) a third state where the fuel/air mixer delivers fuel to the second combustion chamber and the fuel is ignited via the second ignition source to 2) a fourth state where the control unit either controls the fuel/air mixer to cease delivery of fuel to the second combustion chamber or controls the second ignition source to prevent ignition of the fuel.

9. The system according to claim 8 wherein the control unit transitions from the first state to the second state independently from the third state to the fourth state.

10. The system according to claim 1 wherein the engine remains in a running state while in the second state.

11. An engine system comprising:

an internal combustion engine comprising:

an intake comprising a fuel/air mixer;

a first combustion chamber fluidly coupled to the intake;

a first ignition source operably coupled to the first combustion chamber; and an exhaust system fluidly coupled to the first combustion chamber and extending from the first combustion chamber to an outlet, the exhaust system comprising a tailpipe, the outlet formed by the tailpipe;

a control unit configured to control at least one of the fuel/air mixer or the first ignition source; and a first sensor configured to sense a first condition of exhaust within the exhaust system, the first sensor outputting a first signal which is received by the control unit, the first sensor operably coupled to the tailpipe to sense the exhaust at the tailpipe;

wherein, in response to the first signal exceeding a first predetermined threshold while the engine is in a running state, the control unit either causes the fuel/air mixer to cease delivery of fuel or the first ignition source to prevent ignition of the fuel.

12. The system according to claim 11 wherein, in response to the first signal being less than a second predetermined threshold, the control unit causes the fuel/air mixer to resume delivery of the fuel or the first ignition to resume igniting the fuel.

13. The system according to claim 11 wherein the first signal indicates a temperature of the exhaust within the exhaust system.

14. The system according to claim 11 wherein the first signal indicates a ratio of air to fuel.

15. The system according to claim 11 wherein the exhaust system comprises a catalyst located between the first combustion chamber and the outlet, the first sensor configured to sense the exhaust within the exhaust system between the catalyst and the outlet.

16. The system according to claim 11 wherein the system comprises a second sensor, the engine comprises a second combustion chamber, and the exhaust system comprises a first runner fluidly coupled to the first combustion chamber and a second runner fluidly coupled to the second combustion chamber, wherein the first sensor senses the first condition of the exhaust within the first runner and the second sensor senses a second condition of the exhaust within the second runner.

17. The system according to claim 16 wherein the first and second conditions of the exhaust are air/fuel ratios.

18. A method of controlling an internal combustion engine comprising:

a) providing an engine comprising an intake comprising a fuel/air mixer, a first combustion chamber fluidly coupled to the intake, a first ignition source operably coupled to the first combustion chamber, and an exhaust system fluidly coupled to the first combustion chamber and extending from the first combustion chamber to an outlet, the engine in a running state;

b) sensing, via a sensor mounted to a tailpipe of the exhaust system located adjacent the outlet, a first condition of exhaust within the exhaust system exceeding a first predetermined threshold;

c) interrupting fuel delivery from the fuel/air mixer or preventing ignition of the fuel by the first ignition source;

d) monitoring, via the sensor, the first condition of the exhaust until the first condition of the exhaust is less than a second predetermined threshold;

e) resuming fuel delivery from the fuel/air mixer or ignition of the fuel by the first ignition source.

19. The method of claim 18 wherein the first condition is a temperature adjacent the outlet of the exhaust system.

20. The method of claim 18 wherein the first condition is an oxygen content in a runner of the exhaust system.

* * * * *